US005261360A

United States Patent [19]

Voll et al.

[11] Patent Number: 5,261,360

[45] Date of Patent: Nov. 16, 1993

[54] DEVICE FOR ADJUSTING CONTROL TIMES IN A CONTROL DEVICE

[75] Inventors: Bernhard Voll, Essenbach; Dieter Brennecke, Ingolstadt, both of Fed. Rep. of Germany

[73] Assignee: Audi AG, Ingolstadt, Fed. Rep. of Germany

[21] Appl. No.: 923,845

[22] Filed: Jul. 31, 1992

[51] Int. Cl.[5] ..... F01L 1/34

[52] U.S. Cl. ..... 123/90.17; 123/90.31; 464/2; 464/160

[58] Field of Search ..... 123/90.15, 90.17, 90.31; 464/1, 2, 160

[56] References Cited

U.S. PATENT DOCUMENTS

| | | | |
|---|---|---|---|
| 4,841,924 | 6/1989 | Hampton et al. | 123/90.15 |
| 4,895,113 | 1/1990 | Speier et al. | 123/90.17 |
| 5,040,651 | 8/1991 | Hampton et al. | 123/90.15 |
| 5,056,477 | 10/1991 | Linder et al. | 123/90.17 |
| 5,056,479 | 10/1991 | Suga | 123/90.17 |
| 5,067,450 | 11/1991 | Kano et al. | 123/90.17 |
| 5,078,647 | 1/1992 | Hampton | 123/90.17 |
| 5,107,804 | 4/1992 | Becker et al. | 123/90.17 |

FOREIGN PATENT DOCUMENTS

| | | | |
|---|---|---|---|
| 2229248 | 9/1990 | United Kingdom | 123/90.17 |

*Primary Examiner*—E. Rollins Cross
*Assistant Examiner*—Weilun Lo
*Attorney, Agent, or Firm*—Lalos & Keegan

[57] ABSTRACT

A device for adjusting the control times on a control drive of an internal combustion engine, with a gear by the crankshaft of the internal combustion engine, the gear being located on a camshaft for actuating the gas shuttle valve, for which the camshaft can be adjusted relative to the gear over a limited range of angles of rotation. To achieve simple construction, the camshaft can be freely twisted relative to the gear over at least one specific angle of twist in both directions of rotation, and the camshaft is coupled to the gear.

4 Claims, 2 Drawing Sheets

DEVICE FOR ADJUSTING CONTROL TIMES IN A CONTROL DEVICE

BACKGROUND OF THE INVENTION

The invention relates to a device for adjusting the control times in a control drive of an internal combustion engine.

From DE-OS 31 46 613 a device for adjusting the control times in a control drive of an internal combustion engine is known in which each camshaft to be adjusted has an axially movable adjustable adapter which is prevented from turning via a spline connection; the adjustable adapter engages an intermediate wheel driven by the crankshaft of the internal combustion engine via spiral gearing. By moving the adjustable adapter axially, the adjustment of the camshaft relative to the crankshaft, and thus the control time of valves actuated by the camshafts, can be changed. The axial adjustment of the adjustable adapter is done by a special actuating drive.

The object of the invention is to provide a structurally simple device which enables adjustment of the control times with small adjustment forces.

SUMMARY OF THE INVENTION

In contrast to devices suggested in the past, the device as per the invention has no adjustment means which presets or resets the camshaft relative to the driving toothed wheel, but rather provides for free twisting of the camshaft relative to the driving toothed wheel. The means for coupling the camshaft to the driving toothed wheel operates either only in end positions "early" and "late" or if necessary also in the intermediate position. Actual adjustment of the camshaft is effected automatically by floating of the camshaft in conjunction with the alternating torques which occur on the camshaft.

These alternating torques are clearly pronounced for certain cam offsets on the camshaft when the gas shuttle values, pre-tensioned by springs, are actuated, causing automatic twisting of the camshaft relative to the driving toothed wheel, for which decoupling must take place each time for the alternating torque present in the "early" direction or even in the "late" direction.

The alternating torque acting on the camshaft can be easily ascertained when the camshaft is raced. The drive torque can also be measured at the same time. In the area of the leading ramp of a cam, with the gas shuttle valve opened or the valve spring compressed, the driving torque increases, returns to the area of the cam tip on the rubbing part and reverses itself on the exit ramp, because at this point the valve spring strikes the cam or the camshaft in the drive direction. This alternating torque is used as per the invention to adjust the camshaft by means of floating and the proposed coupling which is controlled by the angle of rotation. Of course, the alternating torques in multicylinder internal combustion engines with several cams must be determined for the alternating torques overall in conjunction with the selected valve actuation and the clutch control designed accordingly.

The revolutions per minute of the internal combustion engine are also significant and must be taken into account in the adjustment process. Thus it has been found that at lower rpms (roughly <2500/min), adjustment in the "early" and "late" directions is easily possible, while at higher rpms automatic early adjustment becomes problematic and no longer functions in all camshaft arrangements. Therefore, it is a feature of the invention that early adjustment be accomplished by means of a spring exerting a relative torque on the camshaft in the drive direction of rotation. The spring itself can be of any design (for example, flat spiral spring, coil compression spring, etc.) and should be matched such that for a selected change-over speed, adjustment in the early and late directions is possible. To preclude noise when the adjustment device is changed over, hydraulic motion damping can preferably be provided.

The means for coupling the rotary connection between the camshaft and driving toothed wheel can be pneumatic, hydraulic, electromagnetic or by a positive locking clutch. This clutch can be a toothed clutch in a structurally simple and spatially favorable manner or can be formed by axially adjustable pins which interact in their locked position with corresponding recesses in the driving toothed wheel and with an element permanently connected to the camshaft.

Other advantages of the present invention will become more apparent to those persons having ordinary skill in the art to which the present invention pertains from the following description taken in conjunction with the accompanying drawings.

DETAILED DESCRIPTION OF THE PREFERRED EMBODIMENTS

Figure 1:
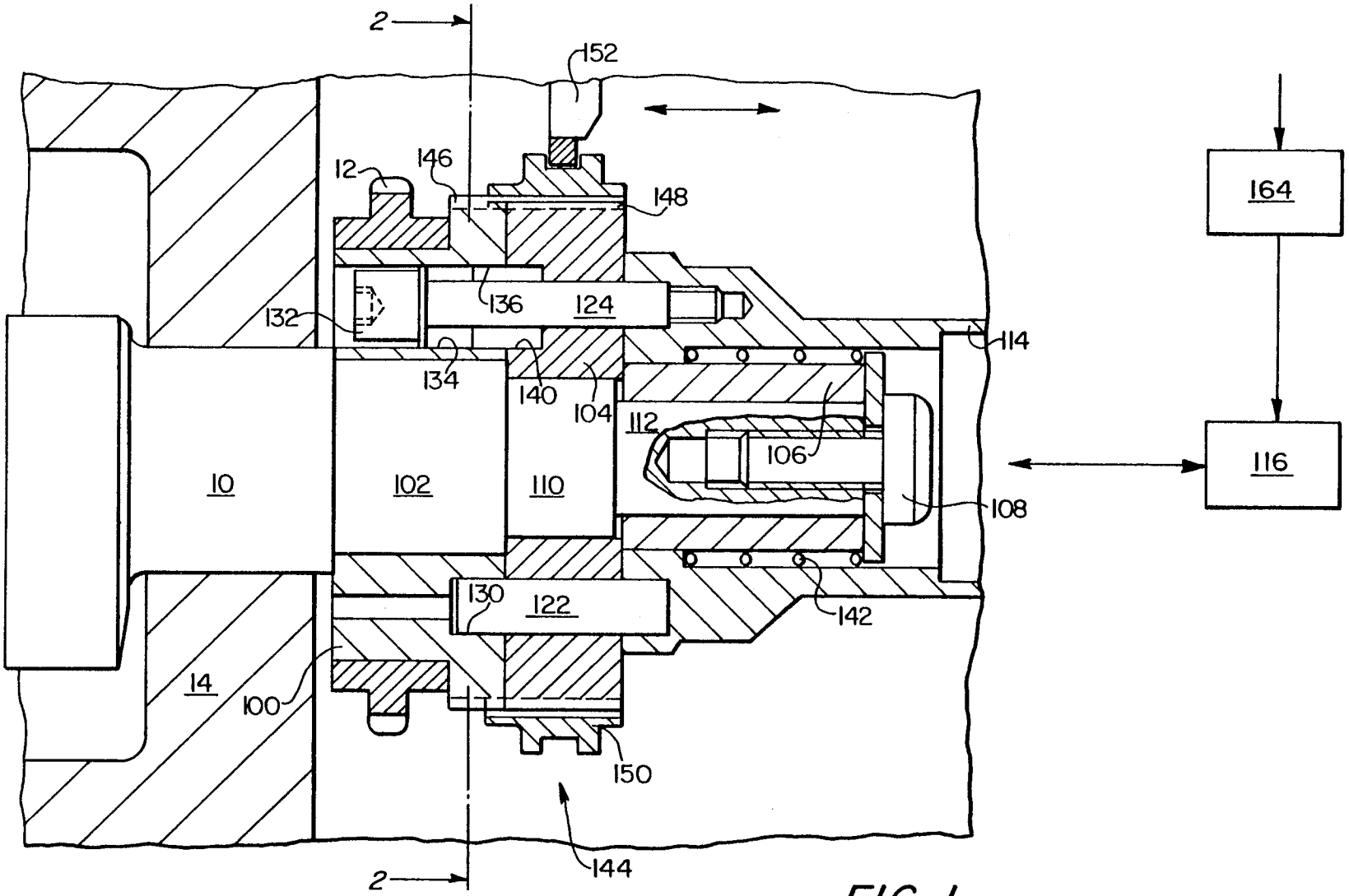
FIG. 1 is a longitudinal section through a device for adjusting a camshaft relative to its driving toothed wheel for a valve-controlled reciprocating internal combustion engine.

A camshaft 10 shown only in sections for a reciprocating internal combustion engine bears several cams (not shown) through which the gas shuttle valves, pretensioned by valve springs into the closed position, are actuated. On the camshaft sits a driving toothed gear 12 which drives the camshaft 10 via a chain (not shown) and a sprocket wheel on the crankshaft (not shown) of the internal combustion engine. The camshaft 10 is mounted via a slide bearing (not shown) in the cylinder head 14 (likewise only partially shown) of the internal combustion engine.

In detail the gear 12 is mounted on a rotationally symmetrical hub part 100 and the latter is in turn pivotally seated on a section 102 (graduated in diameter) of the camshaft 10.

A rotationally symmetrical ring-shaped part 104 and a guide bush 106 in an axial arrangement are connected to the hub part 100; the ring-shaped part and guide bush are held securely via a clamp screw 108 on graduated sections 110, 112 of the camshaft 10.

Figure 2:
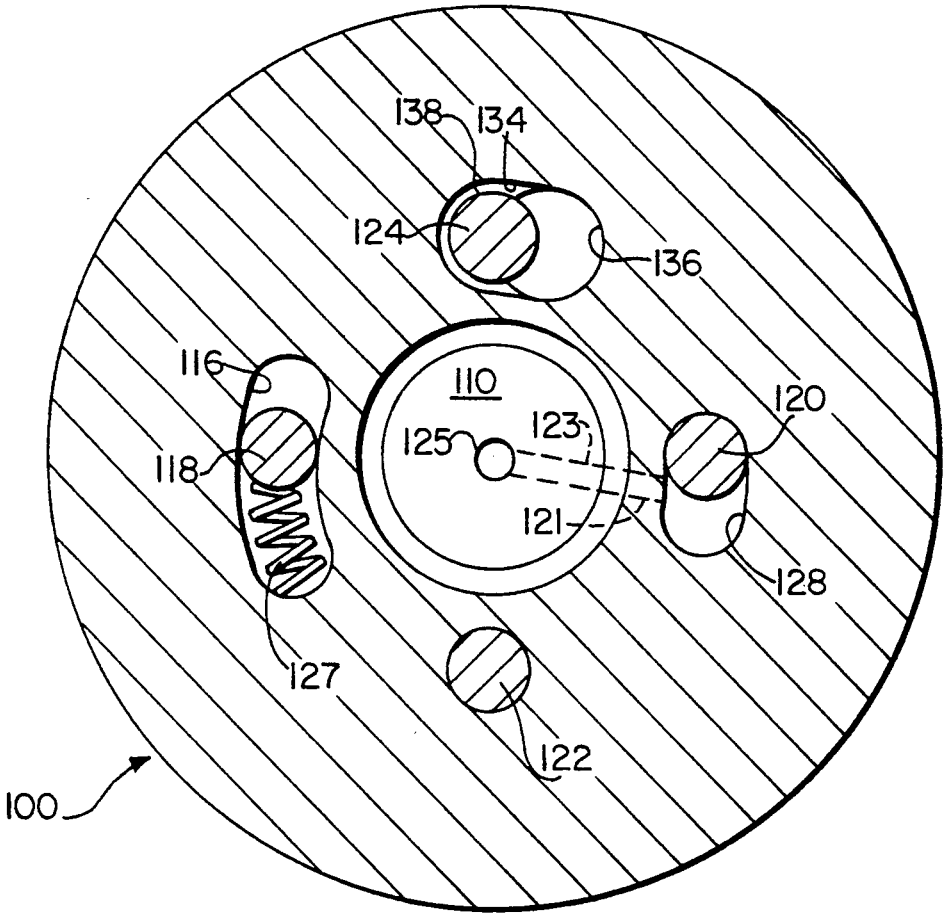
FIG. 2 is a cross-section taken along line II—II of FIG. 1.

An adjustable adapter 114 is mounted to move axially on the guide bush 106. One end of the adapter (not shown) is coupled to a hydraulic servomotor 116 (for example, a piston-cylinder unit). The opposite end bears two stop pins 118, 120 (see FIG. 2) and two locking pins 122, 124. These pins, 118 through 124, extend essentially without play through cylindrical recesses or holes of the ring-shaped part 104 into corresponding recesses of the hub part 100.

The recesses 126, 128 in hub part 100 for the stop pins 118, 120 are slot-shaped and enable relative twisting between the fixed ring-shaped part 104 and the pivotally mounted hub part 100 or the gear 12 fastened on it within the desired camshaft adjustment range. The stop pins 118, 120 are so long that they always engage the recesses 126, 128 in the hub part 100 when the adjustable adapter 114 moves axially.

Locking pin 122 fits into a cylindrical recess 130 of the hub part 100 in the lefthand position (shown in FIG. 1) of the adjustable adapter 114, while it lies in the righthand position only inside the corresponding hole in the ring-shaped part 104. In the locked lefthand position, the camshaft 10 is positioned relative to the gear 12 (via the ring-shaped part 104 and hub part 100) in the "late" position, for which the stop pins 118, 120 lie as shown in the slot shaped recesses 126, 128.

The second locking pin 124 bears a head 132 which is held in a slot shaped recess 134 of the hub part 100, for which its floating in the circumferential direction is equal to the floating of the stop pins 118, 120. Recess 134 extends in the axial direction, not over the entire hub part 100, but graduates into a cylindrical recess 136 into which an elongated hole 138 corresponding to the thickness of the locking pin 124 leads in the circumferential direction.

In addition, a cylindrical recess 140 is machined in the ring-shaped part 104 concentrically to the recess for the locking pin 124; the cylindrical recess 140 is open to the hub part 100 and the head 132 of the locking pin 124 can partially move into the recess 140.

The axial length of the locking pins 122, 124 and head 132 are matched to recesses 134, 136, and 140 such that when the angular position of the camshaft 10 is switched relative to gear 12, by shifting the adjustable adapter 114 (to the right in FIG. 1) the locking pin 122 disengages from recess 130 for the time being to achieve the intermediate position.

In this intermediate position, the camshaft 10 can twist freely in the "early" direction, for which the stop pins 118, 120 shift into the opposite end position of the slot-shaped recesses 126, 128.

At this point, head 132 of the locking pin 124 overlaps the recesses 136 and 140 in this "early" position of the camshaft 10 and can move into recesses 136 and 140, thus locking the "early" position.

While the adjustable adapter 114 is hydraulically adjusted to the right, it is reset by the helical compression spring 142 located between the adjustable adapter 114 and guide bush 106. However, adjustment can also be hydraulically effected via the servomotor 116.

To support automatic adjustment of the camshaft 10 in the "early" direction, a helical compression spring 127 is inserted in the larger, slot-shaped recess 126; the spring exerts a torque (acting on the camshaft 10) on the stop pin 118. However, the spring can also be a torsion spring, flat spiral spring or flat coil spring located in another position and must be matched such that when at the desired change-over rpm, adjustment in the "early" direction and in the "late" direction functions. To damp the free twisting capacity of the camshaft 10 relative to gear 12, recess 128 which forms a closed chamber in the hub part 100 is connected via lubricating oil channels 121, 123 to a central lubricating oil channel 125 in the camshaft 10 which in turn is connected to the pressurized circulating lubricating oil system of the internal combustion engine. In an adjustment motion the lubricating oil in recess 128 is displaced tangentially on the stop pin 128, resulting in hydraulic damping.

Instead of locking pins 122, 124 however, there can also be a toothed clutch 144 which causes locking between the hub part 100 and the ring-shaped part 104. Here there are teeth 146, 148, each on the outside circumference of the hub part 100 and on the outside circumference of the ring-shaped part 104; internally geared gear-shift sleeve 150 is pushed over a gearshift fork 152 (not shown in greater detail) such that it engages each of the two teeth 146, 148 in the locking position and thus the gear 12 couples with the camshaft lo by positive locking.

The gear-shift sleeve 150 can be adjusted, preferably hydraulically via the gearshift fork 152, for example, via the servomotor 116.

To trigger the hydraulic servomotor 116 there is a control device 164 which controls decoupling between the camshaft 10 and drive gear 12 depending on the rpm of the camshaft and by means of a position transmitter, not shown, depending on the rotary angle position, so that, depending on the alternating torque present at the time, the camshaft 10 is adjusted relative to gear 12 in the "early" or "late" direction. With appropriately selected teeth, when using the toothed clutch 144 the desired intermediate positions can also be set.

Camshaft 10 is adjusted as follows in the embodiment with locking pins 122, 124:

It is assumed that camshaft 10 is in the late position (as shown) and is to be adjusted towards early. As soon as the changeover rpm (or one of several changeover rpms) has been reached the locking pins 122, 124 are pre-tensioned to the right via the adjustable adapter 114 into the intermediate position in which the camshaft 10 can twist freely within the float (stop pin 120 in recess 128). By means of the alternating torque which occurs from the closing springs of the gas shuttle valves (not shown), camshaft 10 tries to lead or lag behind within the given float in its rotary speed relative to the rotary speed of the driving toothed wheel. "Leading" is still supported by spring 127 in this process.

However, as soon as the locking pin 124 with head 132 has reached the "early" position, it fits into recesses 136, 140 by further axial shifting via adjustable adapter 114 and fixes the camshaft 10 in the early position by positive locking.

The same thing happens in the reverse sequence when changing over to the late position of the camshaft.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof, limited solely by the appended claims.

We claim:

1. An internal combustion engine comprising:

a crankshaft, a toothed gear driven by the crankshaft, a camshaft for supporting the toothed gear, at least one gas shuttle valve actuated by the camshaft, the camshaft twisting freely relative to the toothed gear in both directions between an early position and a late position over at least one a specific angle of twist, and means for positive locking the gear in the early and late position and allowing free twisting in an intermediate position, the positive locking means including at least two locking pins axially movable between a first position, an intermediate position, and a second position, the at least two locking pins allowing free twisting between the gear and camshaft when in the intermediate position and forming a positive clutch when in the first and second positions.

2. An engine according to claim 1, further comprising at least one spring for pretensioning the camshaft relative to the gear in one of said both directions of rotation.

3. An engine according to claim 2, wherein the spring pretensions the camshaft in said both directions of rotation.

4. An engine according to claim 1, further comprising a lubricating oil system, means for hydraulically damping the free twisting capacity of the camshaft relative to the gear by the lubrication oil system, a slot-shaped recess in the gear, and a ring-shaped part permanently connected to the camshaft, the ring-shaped part including a stop pin, the camshaft including a pair of end rotary stops for stopping the twisting of the camshaft at the early and late positions, wherein the slot-shaped recess and the stop pin form the end rotary stops, the slot-shaped recess being connected to the lubricating oil system by a radial channel.

* * * * *